US008932026B2

(12) United States Patent
Akita

(10) Patent No.: US 8,932,026 B2
(45) Date of Patent: Jan. 13, 2015

(54) FUEL SUPPLY APPARATUS

(75) Inventor: Minoru Akita, Ama (JP)

(73) Assignee: Aisan Kogyo Kabushiki Kaisha, Obu-Shi, Aichi-Ken (JP)

( * ) Notice: Subject to any disclaimer, the term of this patent is extended or adjusted under 35 U.S.C. 154(b) by 101 days.

(21) Appl. No.: 13/329,239

(22) Filed: Dec. 17, 2011

(65) Prior Publication Data

US 2012/0156057 A1 Jun. 21, 2012

(30) Foreign Application Priority Data

Dec. 17, 2010 (JP) ..... 2010-281463

(51) Int. Cl.

| | |
|---|---|
| ***F04B 23/04*** | (2006.01) |
| ***F04B 41/06*** | (2006.01) |
| ***F02D 41/30*** | (2006.01) |
| *F02D 41/20* | (2006.01) |
| *F02M 37/00* | (2006.01) |
| *F02M 39/02* | (2006.01) |
| *F02M 63/02* | (2006.01) |

(52) U.S. Cl.

CPC .... *F02D 41/3082* (2013.01); *F02D 2041/2058* (2013.01); *F02D 2200/0604* (2013.01); *F02M 37/0052* (2013.01); *F02M 39/02* (2013.01); *F02M 63/0225* (2013.01)

USPC ..... 417/2; 417/44.2; 417/44.11; 417/244

(58) Field of Classification Search

USPC ..... 417/2, 44.2, 44.11, 45, 244

See application file for complete search history.

(56) References Cited

U.S. PATENT DOCUMENTS

| | | | | |
|---|---|---|---|---|
| 5,447,414 | A * | 9/1995 | Nordby et al. | 417/20 |
| 8,061,329 | B2 | 11/2011 | Pursifull et al. | |
| 2005/0159639 | A1 * | 7/2005 | Skliar et al. | 600/16 |
| 2009/0304522 | A1 * | 12/2009 | Lelong et al. | 417/5 |
| 2010/0012096 | A1 | 1/2010 | Kieferle et al. | |

FOREIGN PATENT DOCUMENTS

| | | | |
|---|---|---|---|
| CN | 1609432 | A | 4/2005 |
| CN | 101046175 | A | 10/2007 |
| GB | 2454352 | A | 5/2009 |
| JP | 2001289096 | A | 10/2001 |
| JP | 2004-108296 | A | 4/2004 |
| JP | 2006175905 | | 7/2006 |
| JP | 2006175905 | A | 7/2006 |
| JP | 2007198230 | | 8/2007 |
| JP | 2007263090 | | 10/2007 |

(Continued)

OTHER PUBLICATIONS

Chinese Office Action issued Dec. 4, 2013, corresponding to Chinese Patent Application No. 201110425511.4; with English language translation.

(Continued)

*Primary Examiner* — Bryan Lettman
(74) *Attorney, Agent, or Firm* — Ladas & Parry LLP

(57) ABSTRACT

A fuel supply apparatus includes a fuel pump having an electrically driven motor. A controller is connected to the motor of the first fuel pump and is capable of determining an estimated pressure based on a value of current supplied to the motor and a rotational speed of the motor. The controller controls the motor so that the estimated pressure becomes relatively equal to a target pressure.

5 Claims, 3 Drawing Sheets

(56) References Cited

FOREIGN PATENT DOCUMENTS

| | | | |
|---|---|---|---|
| JP | 2009-115087 | A | 5/2009 |
| JP | 2009540205 | | 11/2009 |

OTHER PUBLICATIONS

Japanese Office Action mailed Jan. 7, 2014, corresponding to Japanese Patent Application No. 2010-281463; with English language translation.

* cited by examiner

FUEL SUPPLY APPARATUS

CROSS-REFERENCES TO RELATED APPLICATIONS

This application claims priority to Japanese Patent Application Serial Number 2010-281463, the contents of which are incorporated herein by reference.

BACKGROUND OF THE INVENTION

1. Field of the Invention

The present disclosure relates to fuel supply apparatus for supplying fuel, and in particular to a fuel supply apparatus in which fuel pumped by a low pressure fuel pump is further pressurized to have a high pressure by a high pressure fuel pump before being supplied to a target.

2. Description of the Related Art

Fuel injection systems for an internal combustion engine developed in recent years include a so-called inner-cylinder fuel injection system that directly injects high pressure fuel into a high pressure cylinder.

In a fuel supply apparatus in the inner-cylinder fuel injection system, a low pressure fuel pump and a high pressure fuel pump are placed in series, fuel in a fuel tank is temporarily controlled to a low pressure side target pressure by a low pressure fuel pump, fuel having a low pressure is thereafter converted to a high pressure by a high pressure fuel pump placed at a position near an injector, and the high pressure fuel is then injected from the injector.

In the fuel supply apparatus of the related art, a feedback control is performed so as to obtain the high pressure side target pressure by the use of a high pressure side pressure sensor for the high pressure fuel pump, and a feedback control is performed so as to obtain the low pressure side target pressure by the use of a low pressure side pressure sensor for the low pressure fuel pump.

Thus, the fuel supply apparatus of the related art requires at least two pressure sensors. The incorporation of multiple pressure sensors in pipelines results in excess labor and monetary, prevention structures, construction restrictions the cost of a sensor abnormality detection program as well as the costs for the pressure sensors themselves.

For example, related art described in US Publication No. 2010/0012096 (also published as Japanese Laid-Open Patent Publication No. 2009-540205) discloses a fuel injection apparatus for an internal combustion engine which feeds fuel in a fuel tank to a low pressure region by a feed pump, feeds fuel of the low pressure region to a high pressure region by a high pressure pump, and injects fuel of the high pressure region from an injector. A dedicated low pressure sensor for detecting the pressure in the low pressure region is provided in the low pressure region, and a dedicated high pressure sensor for detecting the pressure in the high pressure region is provided in the high pressure region. Moreover, in the low pressure region, the feed pump is controlled based on the pressure detected by the dedicated low pressure sensor and the high pressure pump is controlled based on the pressure detected by the dedicated high pressure sensor.

Furthermore, for example, related art described in Japanese Laid-Open Patent Publication No. 2006-175905 discloses a pressure control apparatus for brake liquid of a vehicle which enables the reduction in cost of as well as the simplification of the apparatus by controlling the braking force based on the pressures detected by front wheel pressure sensors, a rotational speed of a pump motor, and a liquid pressure estimated from a supply current. Additionally, such a system does not require the use of a relatively expensive liquid pressure sensor for detecting a supply pressure of a liquid pressure source (a gear pump).

Furthermore, related art described in Japanese Laid-Open Patent Publication No. 2007-263090 discloses a fuel injection amount control apparatus for an internal combustion engine which estimates a discharge pressure of a fuel pump based on a predetermined fuel pump characteristic and a detected fuel pump rotational speed.

In the related art described in US Publication No. 2010/0012096, pressure sensors are provided in both low and high-pressure regions. In the related art described in Japanese Laid-Open Patent Publication No. 2006-175905, a liquid pressure sensor is not incorporated, however, front wheel pressure sensors are still necessary. Furthermore, in the related art described in Japanese Laid-Open Patent Publication No. 2007-263090, the discharge pressure of the fuel pump is estimated from a fuel pump characteristic and an actual fuel pump rotational speed, however, due to the fact that a fluctuation of the discharge pressure based on the load of the fuel pump is not taken into account (if the load differs, the pressure differs even in the rotational speed), there is a possibility that the estimated accuracy of the discharge pressure is decreased.

Therefore, there has been a need in the art for further improving fuel supply apparatuses.

SUMMARY OF THE INVENTION

In one aspect of the present teachings, a fuel supply apparatus includes a first fuel pump having an electrically driven motor. A controller is connected to the motor of the first fuel pump and is capable of determining an estimated pressure based on a value of current supplied to the motor and a rotational speed of the motor. The controller controls the motor so that the estimated pressure becomes relatively equal to a target pressure.

DETAILED DESCRIPTION OF THE INVENTION

Figure 1:
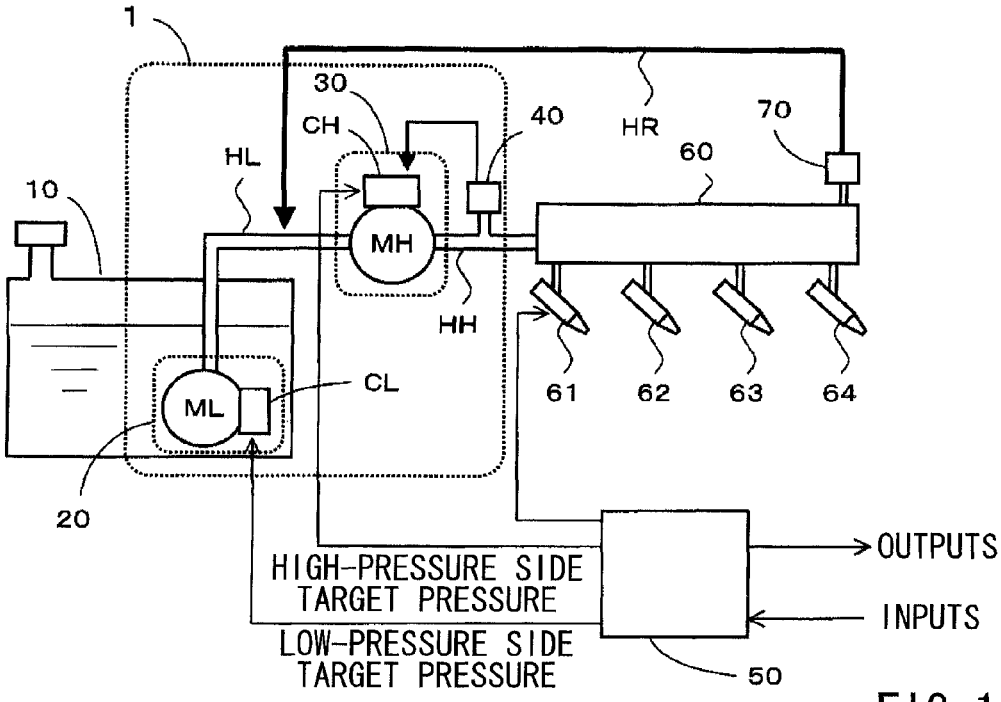
FIG. 1 is a diagram showing an embodiment of a fuel injection system incorporating a fuel supply apparatus.

Each of the additional features and teachings disclosed above and below may be utilized separately or in conjunction with other features and teachings to provide improved fuel supply apparatus. Representative examples of the present invention, which utilize many of these additional features and teachings both separately and in conjunction with one another, will now be described in detail with reference to the attached drawings. This detailed description is merely intended to teach a person of ordinary skill in the art further details for practicing preferred aspects of the present teachings and is not intended to limit the scope of the invention.

Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

In one example, there is provided a fuel supply apparatus in which a low pressure fuel pump and a high pressure fuel pump are provided in series. Fuel is fed to a low pressure region, which is located on a discharge side of the low pressure fuel pump. Fuel is fed to a high pressure region, which is located on a discharge side of the high pressure fuel pump. A pressure detection device is provided in the high pressure region. A high pressure side controller may control the high pressure fuel pump so that the pressure detected by the pressure detection device results in a high pressure side target pressure. No pressure detection device is provided in the low pressure region. The low pressure fuel pump may be a sensorless brushless motor. A low pressure side controller for controlling the brushless motor may detect a value of current supplied to the brushless motor and a rotational speed of the brushless motor. The low pressure side controller may determine an estimated pressure of the fuel on the discharge side of the brushless motor, based on the determined value of current and the determined rotational speed. The lower pressure side controller may control the brushless motor so that the estimated pressure becomes relatively equal to a low pressure side target pressure. The lower pressure side target pressure should be lower than the high pressure side target pressure.

In this arrangement, a pressure sensor is provided in the high pressure region and not in the low pressure region. The discharge pressure (that is, the pressure of the low pressure region) can be estimated from the rotational speed and the current value of the low pressure fuel pump in the low pressure region. This discharge pressure is used to control the low pressure fuel pump. As a result, it is possible to eliminate the pressure sensor on the side of the low pressure fuel pump. Meanwhile it is possible to perform a high precision control using the pressure sensor on the side of the high pressure fuel pump.

In addition, by using the sensor-less brushless motor as the low pressure fuel pump, it is possible to determine the rotational speed and the current value without using an additional rotational speed detection device nor an additional current detection device.

Due to the fact that the controller controls the brushless motor using a rotational position detection signal, the rotational speed can be determined from the rotation detection signal. In addition, because the controller controls the output current using a PWM technique or the like, it is possible to determine the current value from the output.

The fuel supply apparatus may further include a voltage detection device for detecting the voltage of a power source used for the fuel supply apparatus. The low pressure side controller may be configured to correct the current value based on a voltage detected by the pressure detection device and a predetermined reference voltage. Therefore, it is possible to more accurately detect the current value by correcting the current value by the voltage of the power source. By doing so, it is possible to more accurately estimate the discharge pressure (the estimated pressure) of the low pressure fuel pump.

The low pressure side controller may be an independent control device for controlling the brushless motor. A separate external control device may input the low pressure side target pressure to the low pressure side controller. Using such an arrangement, the low pressure side controller may be suitable for certain applications.

An example will now be described with reference to the drawings. FIG. 1 is a diagram showing an embodiment of a fuel injection system of an internal combustion engine incorporating a fuel supply apparatus 1.

<Overall Configuration of Fuel Supply Apparatus (FIG. 1)>

As shown in FIG. 1, the fuel supply apparatus 1 may include a low pressure fuel pump unit 20 and a high pressure fuel pump unit 30. Liquid fuel may be stored in a fuel tank 10. The low pressure fuel pump unit 20 may include a low pressure fuel pump ML and a low pressure side controller CL.

A low pressure side target pressure may be input from a separate external control device 50 (an engine control computer or the like) to the low pressure side controller CL. The low pressure side controller CL preferably controls the low pressure fuel pump ML such that a discharge pressure of the low pressure fuel pump ML (a pressure in a pipeline HL) becomes a low pressure side target pressure and the fuel in the fuel tank 10 is fed into the pipeline HL (corresponding to a low pressure region). The low pressure fuel pump ML may be a sensor-less brushless motor and will be described below in detail.

No pressure detection device is provided in the pipeline HL of the discharge side of the low pressure fuel pump ML. The low pressure side controller CL estimates the pressure in the pipeline HL and controls the low pressure fuel pump ML so that the estimated pressure becomes the low pressure side target pressure.

The high pressure fuel pump unit 30 may include a high pressure fuel pump MH, a high pressure side controller CH and a pressure detection device 40. A high pressure side target pressure may then be input from the separate external control device 50 to the high pressure side controller CH. The high pressure side controller CH controls the high pressure fuel pump MH so that a discharge pressure of the high pressure fuel pump MH (a pressure in a pipeline HH) becomes a high pressure side target pressure. The fuel in the pipeline HL (corresponding to a low pressure region) may then be fed into the pipeline HH (corresponding to a high pressure region).

A pressure detection device 40 is provided in the pipeline HH of the discharge side of the high pressure fuel pump MH. The high pressure side controller CH controls the high pressure fuel pump MH so that the pressure in the pipeline HH becomes the high pressure side target pressure based on the pressure detected by the pressure detection device 40. Injectors 61 to 64 may inject the high pressure fuel in a delivery pipe 60 connected to the pipeline HH based on a driving signal from the external control device 50. For example, when a fuel pressure in the delivery pipe 60 greatly exceeds a hypothetical pressure, fuel may return to the pipeline HL via a valve 70.

Furthermore, detected signals from various input devices (sensors or the like) may be input into the external control device 50. The external control device 50 may output control signals to various output devices (actuators or the like), such as: driving signals to the injectors 61 to 64 and outputs signals representing the low and high pressure side target pressures.

<Configuration of the Low Pressure Fuel Pump Unit (FIG. 2)>

Figure 2:
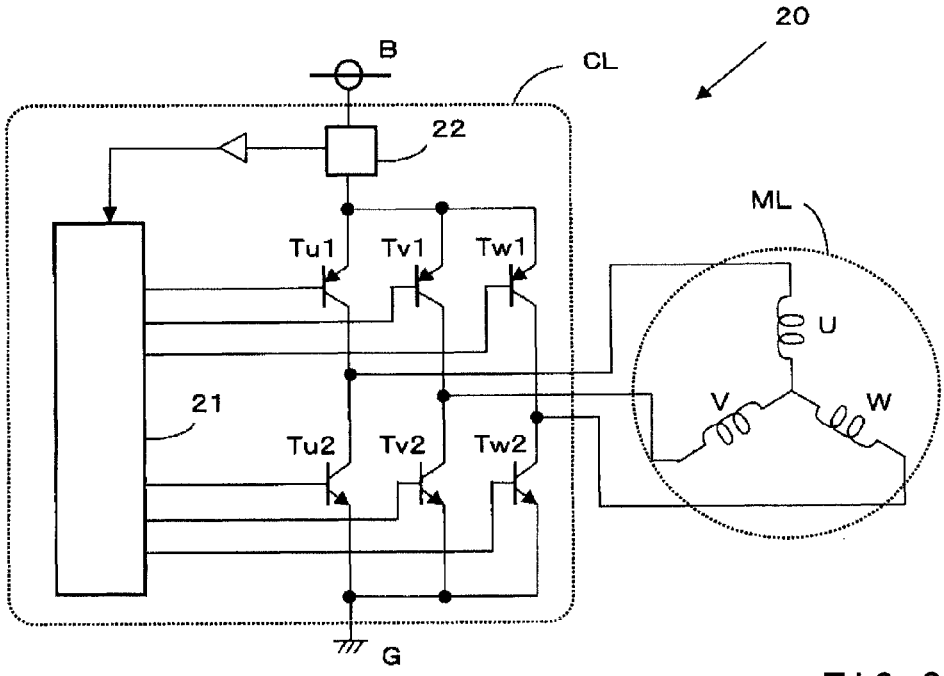
FIG. 2 is a diagram showing an embodiment of a configuration of a low pressure fuel pump unit.

Referring to FIG. 2, the low pressure fuel pump ML may include a sensor-less, brushless motor that has, for example, three-phase coils: U-phase, V-phase and W phase coils. The low pressure side controller CL for controlling the brushless motor has a calculation device 21 such as a CPU, a position detection circuit 22 for detecting a rotation position of the brushless motor and driving circuits (Tu1 to Tw2) that output the driving current to the U phase, the V phase and the W phase coils. The calculation device 21 detects or calculates the rotation position of the brushless motor based on the detected signal from the position detection circuit 22 and outputs the driving signal corresponding to the rotation position from the driving circuits (Tu1 to Tw2).

In one embodiment, the position detection circuit 22 may be a detection circuit for detecting a counter electromotive current. A pulse signal is input to the position detection circuit 22 each time when the brushless motor reaches a predetermined rotational position and the calculation device 21 switches the driving signal (a PWM signal or the like) each time when the pulse signal is input. The calculation device 21 is able to determine the rotational speed of the brushless motor from an interval of pulses of the pulse signal output from the position detection circuit 22. Additionally, the calculation device 21 is able to determine a value of current, which is supplied to the brushless motor, based on the signal (for example, in the case of the PWM signal, the duty of the PWM signal (ratio [%] of an ON pulse width to a pulse period)) which is output to the driving circuits (Tu1 to Tw2) by the calculation device 21.

In this manner, the calculation device 21 is able to detect or determine the rotational speed and the current value of the brushless motor and control the sensor-less, brushless motor. It may be accomplished through the use of an input state from the position detection circuit 22 naturally required for the rotation control and an output state to the driving circuits, without the need in providing a new detection circuit or the like.

[Control Block Diagram (FIG. 3A) of an Embodiment of the Present Invention and Control Block Diagram (FIG. 3B) of Related Art]

Figure 3A:
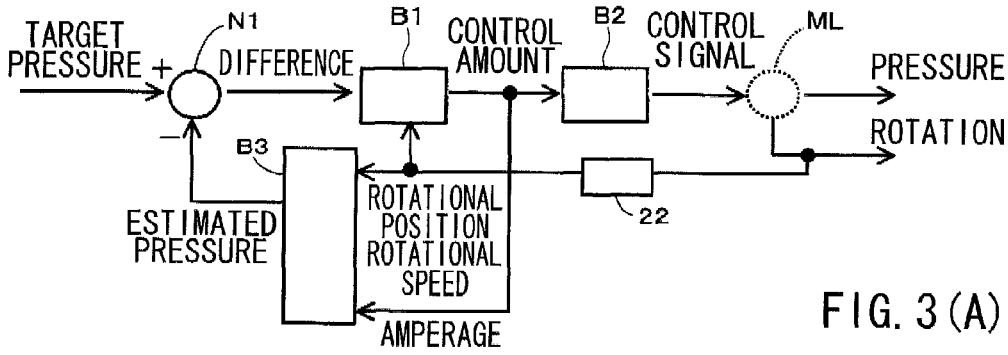
FIG. 3A is a diagram showing an embodiment of a control block diagram.
Figure 3B:
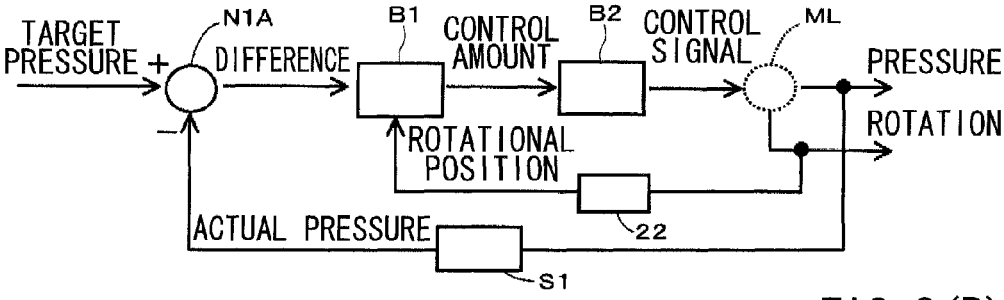
FIG. 3(B) PRIOR ART
FIG. 3B is a diagram showing control block diagrams of the related art.

FIG. 3A shows a control block diagram of an embodiment that controls the low pressure fuel pump ML, and FIG. 3B shows a control block diagram of the related art.

[Control Block Diagram (FIG. 3B) of the Related Art]

As shown in the control block diagram of FIG. 3B, in the related art, a difference between a target pressure (in this case, a low pressure side target pressure) and an actual pressure (an actual discharge pressure from the low pressure fuel pump ML detected by the pressure detection device S1) is obtained by a node N1A and the obtained difference is input to a calculation block B1.

In the calculation block B1, a control amount is calculated based on the input difference. The control amounts suitable for each of the driving circuits (Tu1 to Tw2) are calculated based on the rotation position detection signal from the position detection circuit 22. The calculated control amounts are input to a driving block B2 (the driving circuits (Tu1 to Tw2)). In the driving block B2, the driving signal is output to the low pressure fuel pump ML based on the input control amount.

The discharge pressure from the low pressure fuel pump ML is detected by the pressure detection device. The detected pressure is input to the node N1A for negative feedback. For this reason, in the related art, there is a need for a pressure detection device S1 that detects the discharge pressure of the low pressure fuel pump ML.

[Control Block diagram (FIG. 3A) of an Embodiment of the Present Invention]

As shown in FIG. 3A, in the control block diagram of the present example, the pressure calculation device S1 is not incorporated into the embodiment. Instead, a calculation block B3 that obtains or determines an estimated pressure from the valve of both the current and rotational speed. Such a configuration is not recognized in the prior art (FIG. 3B). In addition, as mentioned above, the position detection circuit 22 is a circuit that is normally used for rotation control. Hereafter, differences between the control block diagram of the present example and the control block diagram of the related art (FIG. 3B) will be described.

In the present example, a value of current (the current value that is supplied to the low pressure fuel pump ML) determined by the control amount obtained by the calculation block B1. The rotational speed (the rotational speed of the low pressure fuel pump ML) is also determined by a detected signal from the position detection circuit 22. Both values are input into the calculation block B3. The discharge pressure of the low pressure fuel pump ML is then estimated by the calculation block B3, and the estimated pressure is input into the node N1 for negative feedback. Thereafter, the difference between the target pressure (in this case, the low pressure side target pressure) and the estimated pressure is obtained by the node N1. The determined difference is then input into the calculation block B1.

[Method of Determining Pressure from Current Value and Rotational Speed (FIG. 4)]

Figure 4:
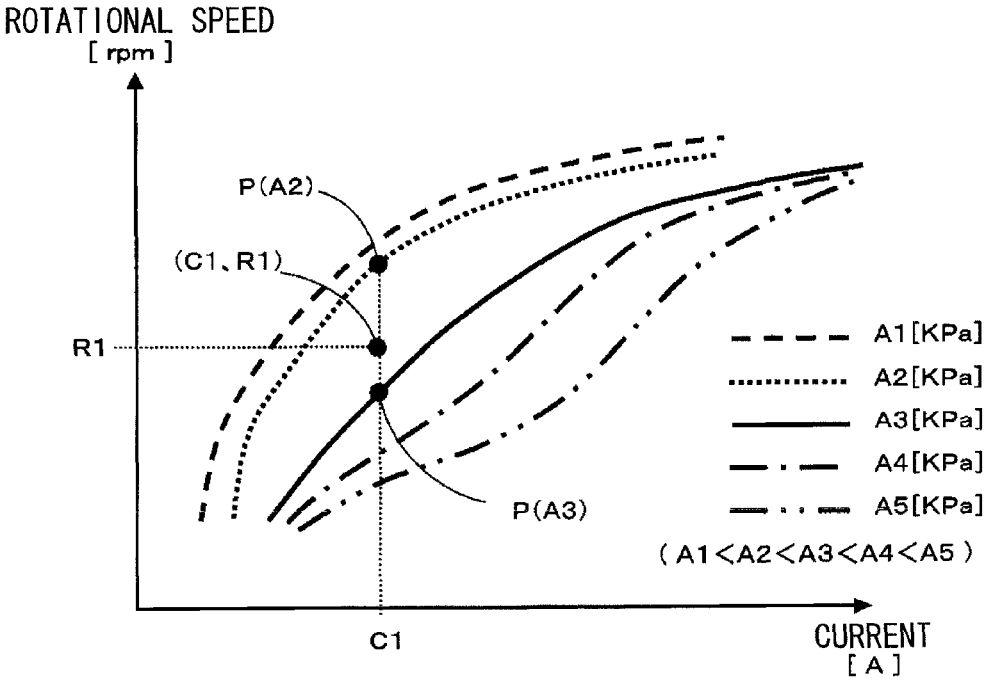
FIG. 4 is a diagram that shows an embodiment of current-rotational speed-pressure characteristics measured in advance in a low pressure fuel pump.

Next, a method (the processing of the calculation block B3 in FIG. 3A) of determining the pressure from the current value and the rotational speed will be described with reference to FIG. 4. FIG. 4 shows a characteristic graph of the low pressure fuel pump ML. A first dashed line indicates a relationship between the current [A] and the rotational speed [rpm] when the discharge pressure is A1 [kPa]. A second dashed line indicates a relationship between the current [A] and the rotational speed [rpm] when the discharge pressure is A2 [KPa]. A solid line indicates a relationship between the current [A] and the rotational speed [rpm] when the discharge pressure is A3 [kPa]. An alternate long and short dash line indicates a relationship between the current [A] and the rotational speed [rpm] when the discharge pressure is A4 [KPa]. A two-dot chain line indicates a relationship between the current [A] and the rotational speed [rpm] when the discharge pressure is A5 [KPa]. Here, there is a relationship of "A1<A2<A3<A4<A5."

When the rotational speed is held constant, as the current increases (thereby increasing the load), the pressure also increases. When the current is held constant, as the rotational speed decreases (thereby increasing the load), the pressure also increases (the discharge pressure).

The calculation device 21 stores the low pressure fuel pump characteristic shown in FIG. 4 and is able to determine the pressure from the detected current value and rotational speed as explained below. In one embodiment, when the detected current value [A] and rotational speed [rpm] are C1 [A] and R1 [rpm], respectively, as shown in FIG. 4, it is possible to obtain the pressure at (C1, R1) by interpolating between a point P (A2) on the A2 [KPa] and a point P (A3) on the A3 [KPa] based on the position at (C1, R1).

As mentioned above, when the rotational speed is known but the load (the current) of the brushless motor is not known, the correct estimation of the discharge pressure is difficult to obtain. When the current (the load) is known but the rotational speed (the flow rate) is not known, the correct estimation of the discharge pressure is also difficult to obtain. In one embodiment, it is possible to estimate the correct discharge pressure of the brushless motor using the rotational speed (the flow rate) and the current (the load).

[Process Sequence (FIG. 5) of Low Pressure Side Controller CL]

Figure 5:
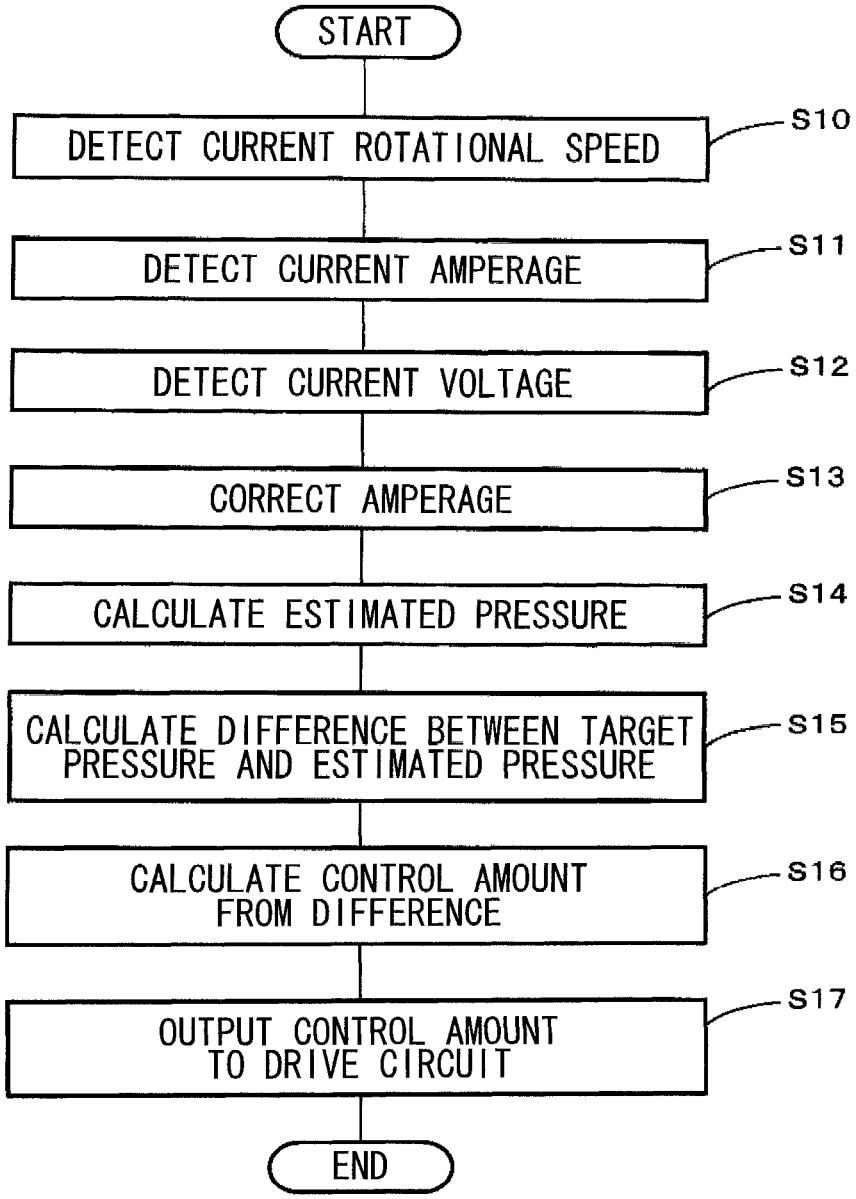
FIG. 5 is an embodiment of a flowchart showing a sequence of controlling the low pressure fuel pump.

Next, an example of a processing sequence of the low pressure side controller CL (the calculation device 21) will be described with reference to FIG. 5. The low pressure side controller CL starts the process shown in FIG. 5 at a predetermined position every time that a detected signal from the position detection circuit 22 is input.

In step S10, the low pressure side controller CL obtains or determines the current rotational speed of the low pressure fuel pump ML from an interval (a period) of pulses of a pulse signal input from the position detection circuit 22. The process then proceeds to step S11.

In step S11, the low pressure side controller CL obtains or determines the current value based on the driving signal that is output to the driving circuits (Tu1 to Tw2) by the controller CL itself. The process then proceeds to step S12.

In step S12, the low pressure side controller CL obtains or determines a measured voltage (which is the voltage of the power source) based on a detected signal input from the voltage detection device that detects the voltage of the power source used in the fuel supply apparatus 1. The process then proceeds to step S13. In one embodiment where the fuel supply apparatus 1 used for a motor vehicle, the power source is a battery installed on the motor vehicle. In such an embodiment, the measured voltage is an actual voltage of the battery.

In step S13, the current value obtained in step S11 is corrected based on a predetermined reference voltage and the measured voltage determined in step S12. The process then proceeds to step S14. In one embodiment, if the low pressure fuel pump characteristic shown in FIG. 4 is a characteristic that is measured for a 12 V reference, the reference voltage is 12 [V]. If the measured voltage is 10 [V], the current value may be corrected as follows.

current value (after correction)=current value determined in step *S*11*(12[V]/10[V])

In step S14, the estimated pressure is obtained based on the rotational speed determined in step S10, the current value corrected in step S13 and the low pressure fuel pump characteristic shown in FIG. 4. The process then proceeds to step S15. In one embodiment, the processes of step S10 to step S14 corresponds to the process performed by the calculation block B3 shown in FIG. 3(A).

In step S15, the low pressure side controller CL obtains or determines a difference between the target pressure (in this case, the low pressure side target pressure) and the estimated pressure. The process then proceeds to step S16.

In step S16, the low pressure side controller CL calculates the control amount of the low pressure fuel pump ML based on the difference obtained in step S15. The process then proceeds to step S17.

In step S17, the low pressure side controller CL drives the driving circuits (Tu1 to Tw2) based on the control amount obtained in step S16 and the rotation position detection signal detected in step S10 in order to drive the low pressure fuel pump ML. At this point, the processes may end.

As mentioned above, the fuel supply apparatus 1, according to one embodiment, may be able to omit the pressure detection device for the low pressure region, and therefore, it is possible to achieve reduction in size of the system and in its cost. Even though the pressure detection device for the low pressure region may be omitted, a final accuracy may be ensured by a pressure detection device for the high pressure region.

Furthermore, in the case of the system in which the power source voltage fluctuates, by correcting the current value by the use of the power source voltage, it is possible to accurately obtain the estimated pressure.

Additionally, by using the low pressure side controller CL as an independent control device, it is possible to simplify the connection of the wiring between the low pressure side controller CL and the external control device 50 or the low pressure fuel pump ML It is also possible to simplify the handling of the input signal, thus resulting in an increased amount of construction freedom.

The fuel supply apparatus 1 of embodiments of the invention may be modified in various ways. For example, the characteristic of the low pressure fuel pump ML may not be restricted to that shown in FIG. 4. Further configurations of the low pressure side controller CL and the low pressure fuel pump ML may not be restricted to those shown in FIG. 2.

What is claimed is:

1. A fuel supply apparatus comprising:

a low pressure fuel pump and a high pressure fuel pump provided in series with each other, the low pressure fuel pump comprising a brushless motor and being configured to feed fuel to a low pressure region, which is a discharge side of the low pressure fuel pump, and the high pressure fuel pump being configured to feed fuel to a high pressure region, which is a discharge side of the high pressure fuel pump;

a pressure detection device provided in the high pressure region, without a pressure detecting device being provided in the low pressure region;

a high pressure side controller configured to control the high pressure fuel pump so that the pressure detected by the pressure detection device becomes relatively equal to a high pressure side target pressure; and a low pressure side controller configured to determine a value of current supplied to the brushless motor, and a rotational speed of the brushless motor, determine an estimated pressure of fuel on the discharge side of the low pressure fuel pump based on the determined current value and the determined rotational speed, and control the brushless motor so that the determined estimated pressure becomes relatively equal to a low pressure side target pressure which is lower than the high pressure side target pressure.

2. The fuel supply apparatus as in claim 1, further comprising a voltage detection device configured to detect a voltage of a power source to be used in the fuel supply apparatus, wherein the low pressure side controller is further configured to correct the current value based on a voltage detected by the voltage detection device and a predetermined reference voltage.

3. The fuel supply apparatus as defined in claim 1, wherein the low pressure side controller is configured as an independent control device for controlling the brushless motor, and the lower pressure side controller receives input of the low pressure side target pressure from a separate external control device.

4. A fuel supply apparatus comprising:

a first fuel pump having an electrically driven motor;

a first controller communicating with the motor of the first fuel pump and capable of determining an estimated pressure of fuel discharged from the first fuel pump based on a value of current supplied to the motor, and a rotational speed of the motor;

wherein the first controller controls the motor so that the estimated pressure becomes relatively equal to a first target pressure;

a second fuel pump having an electrically driven motor and connected in series with the first fuel pump on a downstream side thereof, a pressure detection device configured to detect a pressure of fuel discharged from the second fuel pump; and a second controller communicating with the motor of the second fuel pump and configured to control the motor so that the pressure detected by the pressure detection device becomes relatively equal to a second target pressure that is higher than the first target pressure.

5. The fuel supply apparatus as in claim 4, further comprising a third controller communicating with the first controller and outputting the first target pressure to the first controller, wherein the first controller is configured as a separate controller from the third controller.

* * * * *